United States Patent [19]

Strand

[11] Patent Number: 4,877,159

[45] Date of Patent: Oct. 31, 1989

[54] POUR DISPENSER

[75] Inventor: Victor Strand, Yorba Linda, Calif.

[73] Assignee: Strand Art Co., Inc., Anaheim, Calif.

[21] Appl. No.: 225,195

[22] Filed: Jul. 28, 1988

[51] Int. Cl.[4] ..... B67D 3/00; B65D 47/00

[52] U.S. Cl. ..... 222/484; 222/487; 222/518; 222/545

[58] Field of Search ..... 222/483, 484, 487, 511, 222/518, 545, 482; 137/630.9

[56] References Cited

U.S. PATENT DOCUMENTS

| | | | |
|---|---|---|---|
| 754,618 | 3/1904 | Smith et al. | 137/588 |
| 1,553,113 | 9/1925 | Rutt | 222/484 |
| 2,017,133 | 10/1935 | Rice . | |
| 2,197,352 | 4/1940 | Terkel | 222/518 |
| 2,319,517 | 5/1943 | Rand | 222/518 |
| 2,779,517 | 1/1957 | Beall . | |
| 2,915,224 | 12/1959 | Beall . | |
| 2,939,611 | 6/1960 | Nebinger | 222/484 |
| 2,963,205 | 12/1960 | Beall . | |
| 3,220,617 | 11/1965 | Veistrup . | |
| 3,258,160 | 6/1966 | Allen . | |
| 3,739,938 | 6/1973 | Paz . | |
| 4,664,297 | 5/1987 | Giovinazzi | 222/484 |
| 4,722,463 | 2/1988 | Anderson . | |

FOREIGN PATENT DOCUMENTS

| | | |
|---|---|---|
| 102353 | 8/1898 | Fed. Rep. of Germany . |
| 360480 | 10/1922 | Fed. Rep. of Germany . |

OTHER PUBLICATIONS

Newspaper Clipping Entitled "Partners Hope Dispenser Will Help Them Tap Line of Success".

*Primary Examiner*—Kevin P. Shaver
*Assistant Examiner*—Mona C. Beegle
*Attorney, Agent, or Firm*—Harris, Kern, Wallen & Tinsley

[57] ABSTRACT

A pour dispenser for pouring fluid from a container and including a body having an outlet nozzle and adapted for mounting on a container, a piston in the body and slideable between a valve open condition providing a first flow path between the container and the nozzle and a valve closed condition blocking fluid flow between the container and the nozzle, a plunger in the piston and slideable between a valve open condition providing a second fluid flow path between the container and the atmosphere and a valve closed condition blocking fluid flow between the container and the atmosphere, and springs between the plunger, piston and body for urging the plunger and the piston to the valve closed conditions, with plunger actuation opening the second fluid flow path and then opening the first fluid flow path.

8 Claims, 2 Drawing Sheets

POUR DISPENSER

BACKGROUND OF THE INVENTION

This invention relates to a dispenser for pouring fluid from a container, and is particularly adapted for use with the present-day two and three liter plastic soda bottles. In such containers, the product is charged with gas under pressure and packaged, shipped and sold with an adequate seal. However problems arise when the entire contents are not used following the opening of the bottle, with the product usually going flat when the original cap is used for reclosing. Also, pouring from the large containers often results in surging or gurgling with spillage and waste of product.

However the pour dispenser of the invention is not limited to this specific application, and may be utilized with a variety of containers for a wide range of products for pouring a fluid and for resealing the container.

In the preferred embodiment illustrated, the pour dispenser of the invention is adapted for screwing onto a screw top bottle, after initial removal of the cap. However other arrangements for attaching the dispenser to the container can be utilized, and the dispenser can be made an integral part of the container if desired.

Accordingly, it is an object of the invention to provide a new and improved pour dispenser for use with a container for control of pouring of fluid from the container. A further object is to provide such a dispenser incorporating built in seals which will retain pressure in the container and maintain fluid freshness when the dispenser is closed. An additional object is to provide a pour dispenser which provides for pressure release of a charged container prior to pouring and in particular, which provides a pressure release and vent passage separate from the pour passage.

It is a particular object of the invention to provide such a new and improved pour dispenser which does not require any sliding seals and which can be produced by conventional molding techniques and easily assembled without requiring separate fasteners or fastening operations.

Other objects, advantages, features and results will more fully appear in the course of the following description.

SUMMARY OF THE INVENTION

In the preferred embodiment, the pour dispenser of the invention provides for pouring fluid from a container and resealing the container, and includes a body having an outlet nozzle and an adapter for mounting the body on a container, a piston in the body, a plunger in the piston, and springs between the plunger, piston and body for urging the plunger and piston to valve closed conditions. Pressure on the plunger compresses the spring and moves the plunger to a valve open condition to open a fluid flow path between the container and the atmosphere and then moves the piston to a valve open condition to open a fluid flow path between the container and the nozzle. Releasing the plunger closes both fluid flow paths.

In the preferred embodiment, the piston and body have first interengaging valve means with the piston slideable in the body between a first valve open condition providing the first flow path between the container and the nozzle, and a first valve closed condition blocking fluid flow between the container and the nozzle.

Also the plunger and piston have second interengaging valve means with the plunger slideable in the piston between a second valve open condition providing the second fluid flow path between the container and the atmosphere, and a second valve closed condition blocking fluid flow between the container and the atmosphere.

DESCRIPTION OF THE PREFERRED EMBODIMENT

Figure 1:
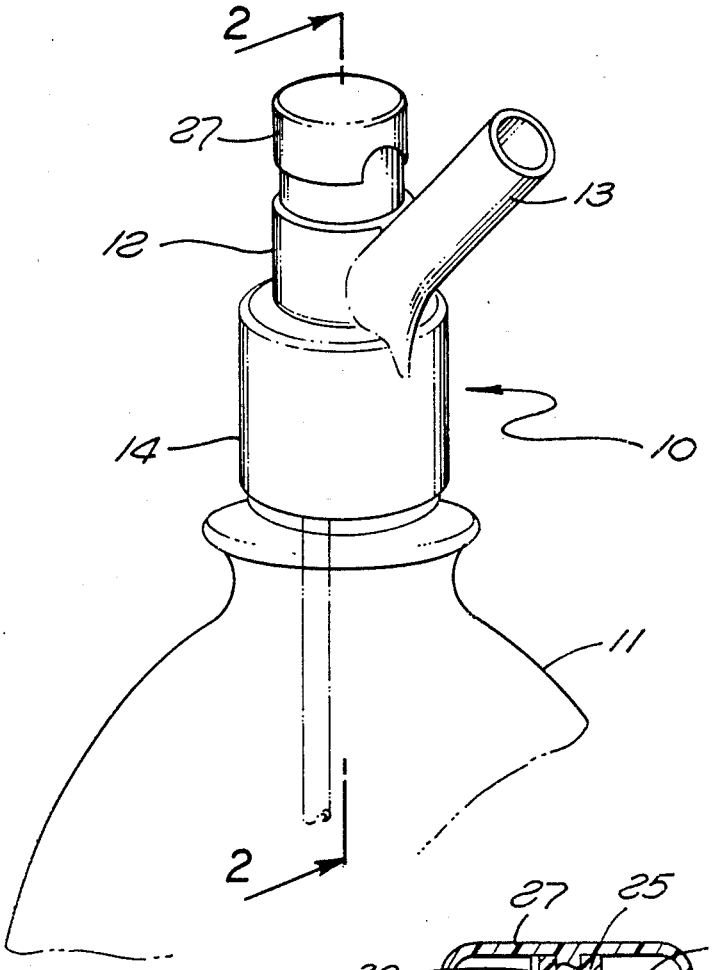
FIG. 1 is a perspective view of a pour dispenser mounted on a container, and incorporating the presently preferred embodiment of the invention.

In the drawings, FIG. 1 shows the presently preferred embodiment of the dispenser 10 mounted on a bottle 11. A body 12 has an integrally formed nozzle 13, and an adapter 14 carried at the lower end of the body 12 for mounting the body on the container 11. The mode of attachment of the body to the container will vary with the type of container, and a screw on configuration is shown in the embodiment illustrated. In alternative configurations, the adapter could be formed integral with the body, and even in some applications, the body could be formed integral with the container.

Figure 3:
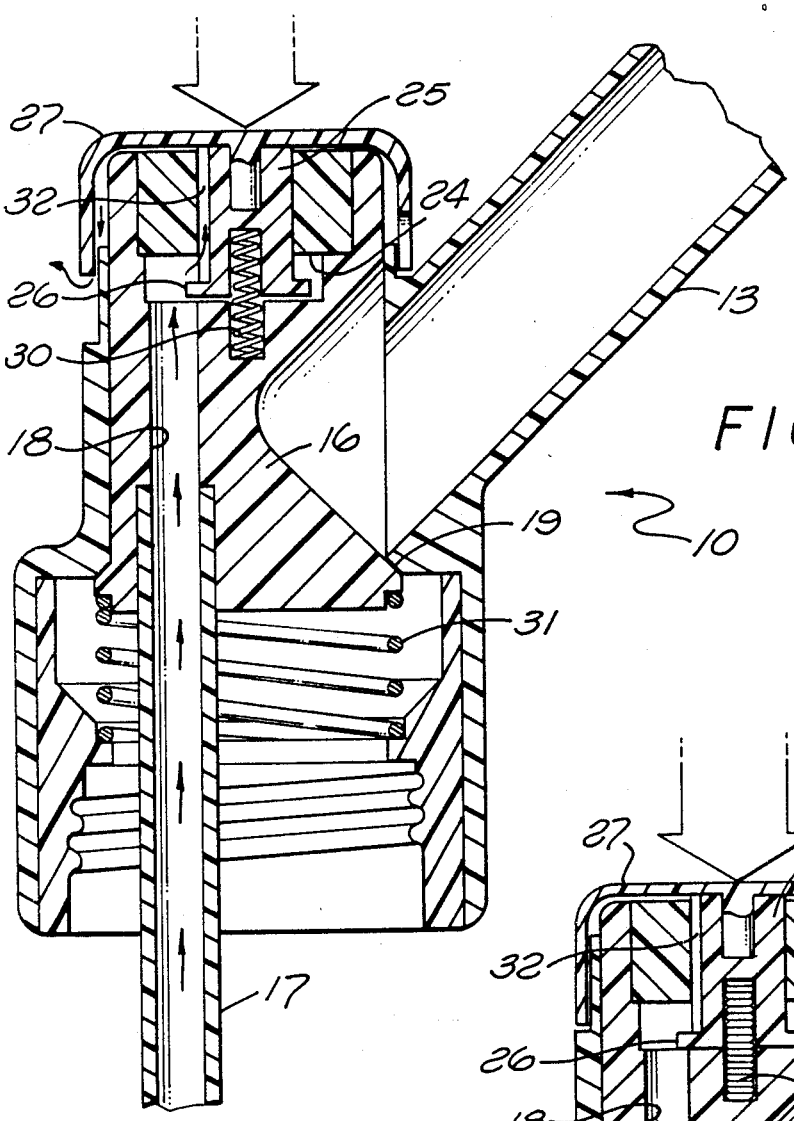
FIG. 3 is a view similar to that of FIG. 2 showing the dispenser in the vent condition.
Figure 4:
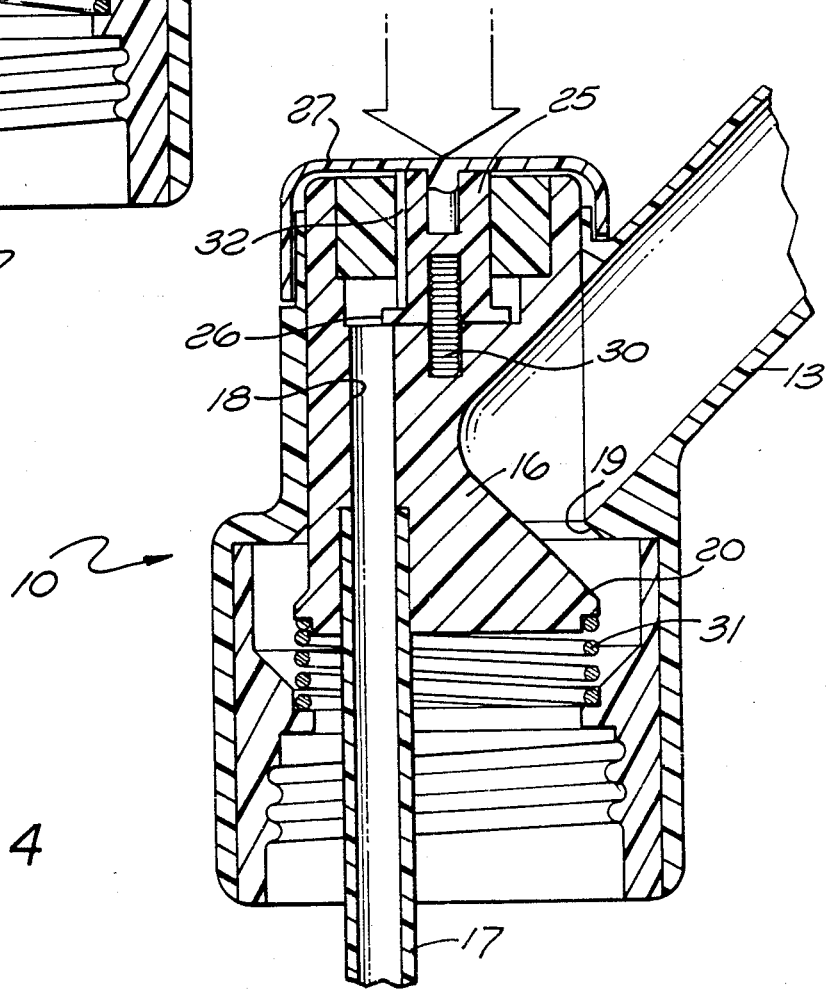
FIG. 4 is a view similar to that of FIGS. 2 and 3 showing the dispenser in the pouring condition.

A piston 16 is slideably positioned within the body 12, and in the embodiment illustrated has a vent tube 17 carried at the lower end of a passage 18 through the piston. The optimum length and shape of the vent tube may vary, depending on the size and shape of the bottle. A frusto-conical valve seat 19 is formed within the body 12, and the piston has a mating frusto-conical portion 20 for engaging the body valve seat 19. The valve formed by the body and piston is in the closed condition in FIGS. 2 and 3, and in the open condition in FIG. 4 providing a flow path from the container to the nozzle.

In the embodiment illustrated, a spacer ring 23 is carried in the upper end of the piston 16 and has a lower planar surface 24 which serves as a valve seat for a plunger 25 which slides in the central opening of the spacer ring. The spacer ring has an annular shoulder 26 which engages the seat 24 to provide a valve closed condition, and also retain the plunger on the piston. A cap 27 may be mounted on the upper end of the plunger 25 to provide an enlarged surface and a closed appearance, as best seen in FIG. 1.

A spring 30 is positioned in aligned recesses of the piston 16 and plunger 25, for urging the plunger upward closing the valve between the piston and the plunger. A flow path is provided from the interior passage 18 of the piston past the valve seat 24 to the atmosphere and in the embodiment illustrated includes a longitudinal groove 32 in the plunger 25. Another spring 31 is positioned between the piston 16 and the adapter 14 of the body 12, for urging the piston upward closing the valve between the body and piston.

Figure 2:
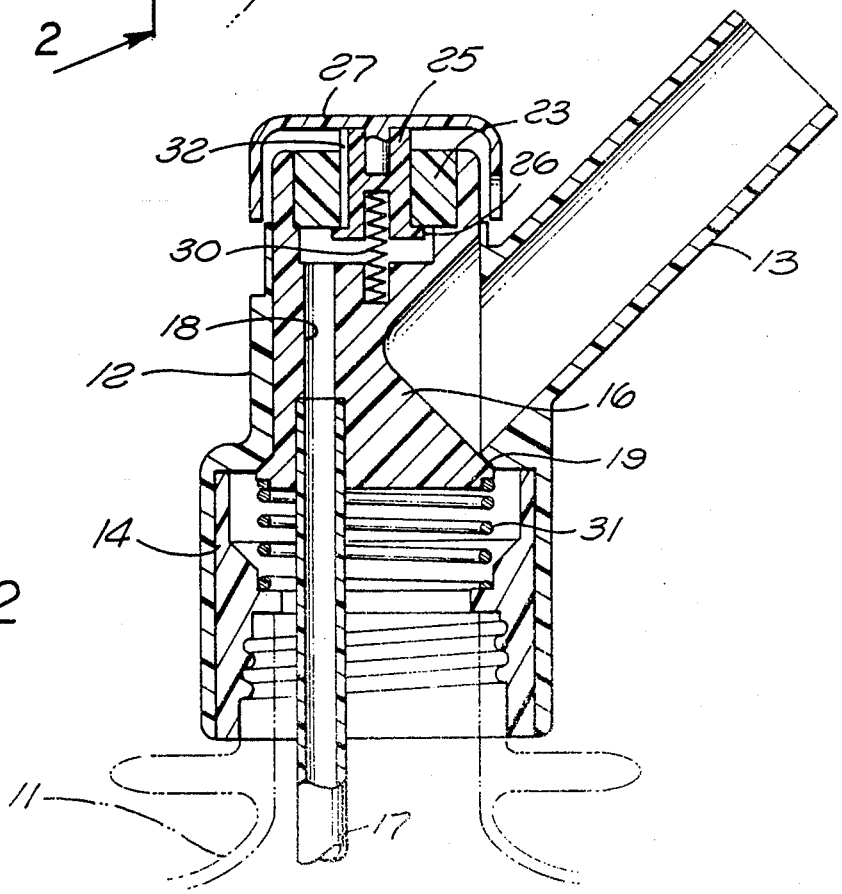
FIG. 2 is an enlarged sectional view taken along the line 2—2 of FIG. 1, showing the dispenser in the closed condition.

In operation, the dispenser is screwed onto the container in the condition of FIG. 2. When the user desires to pour liquid from the container, the cap 27 is pushed downward, compressing the spring 30 and opening the valve at the seat 24. This is the condition shown in FIG. 3, which permits any gas under pressure within the container to vent through the vent tube, the piston, the groove in the plunger, and outward under the cap to the atmosphere, as shown by the arrows in FIG. 3. During this operation, the piston remains seated against the body at the valve seat 19.

Further downward movement of the cap further compresses the spring 30 and brings the lower end of the plunger 25 into engagement with the piston 16, pushing the piston downward in the body, compressing the spring 31, and opening the valve at the seat 19. This is the condition shown in FIG. 4. Now the container can be tipped to pour liquid from the container outward through the nozzle 13, with air flowing in through the previously described vent path. With this arrangement, a smooth flow of liquid from the container is achieved without surging or gurgling. Pouring is terminated by releasing the cap, which closes both valves and returns the dispenser to the condition of FIG. 2.

All of the elements of the dispenser can be produced by injection molding using Food and Drug Administration approved polymer materials. The components may be assembled by snapping together in an inverted locking fashion which permits the parts to be assembled, but not disassembled. This can be accomplished without requiring other fasteners or bonding materials. Thus it is seen that the present invention provides a simple yet elegant dispenser which meets the objects previously discussed and which is easily and inexpensively produced while meeting sanitary and health requirements.

I claim:

1. In a pour dispenser for pouring fluid from a container, the combination of:

a body having an outlet nozzle and an adapter for mounting said body on a container;

a piston in said body, with said piston and body having first interengaging valve means with said piston slideable in said body between a first valve open condition providing a first flow path between the container and said nozzle, and a first valve closed condition blocking fluid flow between the container and said nozzle, said piston including a vent line for positioning in the container;

a plunger in said piston, with said plunger and piston having second interengaging valve means with said. plunger slideable in said piston between a second valve open condition providing a second fluid flow path between the container and the atmosphere, and a second valve closed condition blocking fluid flow between the container and the atmosphere; and spring means between said plunger, piston and body for urging said plunger to said second valve closed condition and said piston to said first valve closed condition, with pressure on said plunger actuating said spring means and moving said plunger to said second valve open condition to open said second fluid flow path and then moving said piston to said first valve open condition to open said first fluid flow path.

2. A dispenser as defined in claim 1 wherein said second interengaging valve means includes:

a valve seat carried on said piston; and a mating seat engaging element carried on said plunger, with said plunger positioned in said piston to engage said piston and move said piston in said body after said plunger moves said seat engaging element away from said valve seat.

3. A dispenser as defined in claim 2 wherein said valve seat is a planar surface and said seat engageable element is an annular shoulder which moves toward and away from said planar surface.

4. A dispenser as defined in claim 2 wherein said first interengageable valve means includes:

a frusto-conical valve seat carried in said body; and a mating frusto-conical seat engaging element carried in said piston.

5. A dispenser as defined in claim 1 wherein said adapter is formed separate from said body and joined to said body at a body opening, and said piston is slideably inserted into said body through said body opening.

6. A dispenser as defined in claim 5 wherein said second interengaging valve means includes a seal ring with a plunger opening and mounted in said piston, and said plunger is slideable in said seal ring plunger opening and includes a shoulder projecting beyond said opening retaining said plunger in said piston.

7. A dispenser as defined in claim 1 wherein said spring means includes a first compression spring between said plunger and said piston, and a second compression spring between said piston and said body.

8. In a pour dispenser for pouring fluid from a container, the combination of:

a body for mounting on a container and having an outlet nozzle;

a piston slideably mounted in said body to form a first valve moveable between a first valve open condition and a first valve closed condition;

a plunger slideably mounted in said piston to form a second valve moveable between a second valve open condition and a second valve closed condition; and spring means between said plunger, piston and body for urging said plunger and piston to said valve closed conditions, with pressure on said plunger actuating said spring means and moving said plunger to said second valve open condition and then moving said piston to said first valve open condition.

* * * * *